United States Patent [19]

Brush, Jr. et al.

[11] Patent Number: 4,624,515

[45] Date of Patent: Nov. 25, 1986

[54] ELECTRICAL CONNECTOR WITH GROUNDING CLIP

[75] Inventors: Robert W. Brush, Jr., North Brunswick; Robert M. Scharf, Bedminster, both of N.J.

[73] Assignee: Thomas & Betts Corporation, Raritan, N.J.

[21] Appl. No.: 724,237

[22] Filed: Apr. 17, 1985

[51] Int. Cl.[4] ..... H01R 4/66

[52] U.S. Cl. ..... 339/14 R

[58] Field of Search ..... 339/14 R, 143 R, 147 R, 339/14 T, 143 T

[56] References Cited

U.S. PATENT DOCUMENTS

| | | | |
|---|---|---|---|
| 3,548,360 | 12/1970 | Schlueter | 339/14 R |
| 3,713,073 | 1/1973 | Narozny | 339/17 F |
| 3,731,251 | 5/1973 | Sinclair | 339/17 F |
| 3,825,874 | 7/1974 | Peverill | 339/14 R |
| 4,005,921 | 2/1977 | Hadden et al. | 339/14 R |
| 4,006,957 | 2/1977 | Narozny | 339/103 M |
| 4,027,941 | 6/1977 | Narozny | 339/14 R |
| 4,109,222 | 8/1978 | Frano et al. | 339/143 R |
| 4,140,360 | 2/1979 | Huber | 339/176 MF |
| 4,195,893 | 4/1980 | Stupay | 339/14 R |
| 4,367,909 | 1/1983 | Shatto, Jr. et al. | 339/14 R |
| 4,415,216 | 11/1983 | Narozny | 339/107 |
| 4,437,723 | 3/1984 | Narozny | 339/99 R |
| 4,464,003 | 8/1984 | Goodman et al. | 339/14 R |
| 4,519,665 | 5/1984 | Althouse et al. | 339/147 R |

OTHER PUBLICATIONS

IBM Bulletin, "Multicontact Plug with Improved Grounding", Kimmerle et al., vol. 22, No. 6, Nov. 1979.

*Primary Examiner*—Gil Weidenfeld
*Assistant Examiner*—Gary F. Paumen
*Attorney, Agent, or Firm*—Robert M. Rodrick; Salvatore J. Abbruzzese

[57] ABSTRACT

An electrical connector for terminating shielded flat multi-conductor cable is divided. The connector includes a housing having a metal connector shell. A conductive clip is provided which engages in unison contacts of the connector associated with the ground conductors of the cable. The conductive clip also engages the metal shell of the connector housing. The conductive clip provides a ground reference for the connector and for the cable at its terminated end.

9 Claims, 9 Drawing Figures

ELECTRICAL CONNECTOR WITH GROUNDING CLIP

FIELD OF THE INVENTION

The present invention relates generally to an electrical cable connector providing ground connection to selected ones of the connector contacts and more particularly to a device for mass grounding plural contacts of an electrical connector for flat multiconductor cable.

BACKGROUND OF THE INVENTION

In the electronic interconnection field it is well known that signal transmission through electrical cable may be adversely effected by electromagnetic and radio frequency interferences (EMI and RFI). Electrical cable, especially that formed in a flat array, known as ribbon cable, typically includes a plurality of spaced The flat cable assembly typically includes a metallic shield over the length thereof which provides a further conductive path to drain EMI and RFI interferences. Similarly the electrical connector is also shielded by placement in a metal housing, commonly referred to a metal shell, and connecting the housing to the shield of the conductors contained in an insulative housing. In order to effectively shield the cable and connector the shield is typically placed at ground potential. Various signal transmission applications employing such flat multiconductor cables have signal shielding requirements which demand that each signal conductor be disposed between a pair of ground conductors to provide a ground reference for the cable. Thus, signal transmission requirements could be met by connecting the ground conductors of the flat multiconductor cable to the metal shell of the connector and the metallic shield of the cable. Various devices are known which connect the metallic shield of the cable to the back shell of the connector. One such device is shown in commonly assigned U.S patent application Ser. No. 665,971 filed Sept. 18, 1984, and entitled FLAT CABLE CONNECTOR WITH GROUNDING CLIP, now abandoned. Thus, complete grounding of the ground conductors can be accomplished by connecting these selected ground conductors to the metal shell of the connector. Connection of the ground conductors to the metal shell of the connector could be accomplished by individually connecting each of the dedicated ground conductors to the metal shell itself. However, this would involve stripping the individual conductors of the cable or other wire preparation and then soldering the conductors to the metal shell to complete the connection. An alternative method to connect the ground conductors of the cable to the metal shell is to ground the connector contacts associated with the dedicated ground conductors of the cable. Again, this can be accomplished in an individual manner, however, the contacts are arranged in the connector housing in such close proximity as to afford less than adequate room for individual connection.

It is, therefore, necessary to look toward mass connecting each of the connector contacts associated with the dedicated ground conductors. As the electrical contacts in a mass termination electrical connector are typically insulation displacing contacts the ground connection device should not interfere with the insulation displacing portions of the electrical contacts and their connection to the flat cable conductors.

SUMMARY OF THE INVENTION

It is the object of the present invention to provide shielding from electromagnetic and radio frequency interferences for a multiconductor cable.

It is a further object to provide a conductive element in an electrical cable connector assembly which provides for electrical continuity between selected ground conductors of the signal cable and the conductive shell of the electrical connector.

The present invention contemplates providing a conductive element which surrounds the connector housing and provides for electrical continuity between selected ground conductors of the cable and the metal shell of the connector. Certain electrical contacts of the cable connector associated with the dedicated ground conductors of the cable are placed in electrical connection with the outer conductive shell supporting the connector housing.

In a preferred embodiment of the present invention an electrical connection assembly for flat signal cable is shown. The connector includes an insulative housing for supporting the cable and houses a plurality of contacts for electrical engagement with cable conductors. The housing is supported in a conductive shell for electrical shielding purposes. A conductive element is further provided having a first portion alignable with the electrical contacts and being in electrical engagement with selective contacts of the connector. These selected contacts are associated with ground conductors of the electrical cable. A second extent of the conductive element is engageable with the conductive shell of the housing for providing electrical continuity between the selected contacts and the conductive shell and thereby, providing complete sheilding throughout the connector.

DETAILED DESCRIPTION OF THE PREFERRED EMBODIMENT

Figure 1:
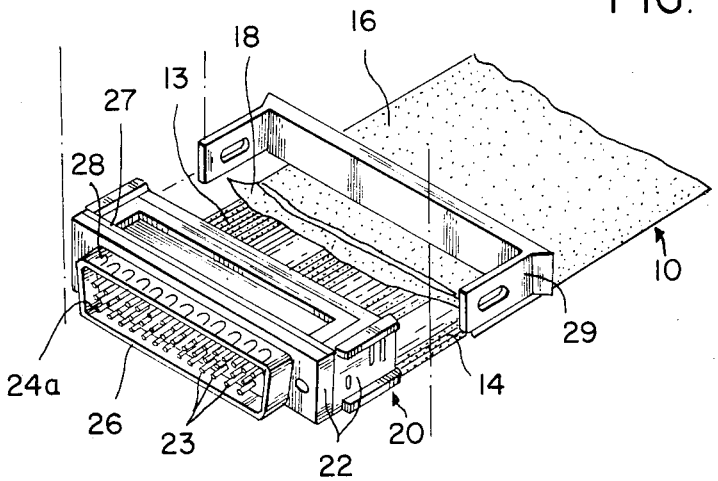
FIG. 1 is a prospective showing of a flat multiconductor shielded cable and a mass termination electrical connector employed in the present invention.

A length of cable assembly 10 is shown in FIG. 1, which comprises a plurality of transversely spaced electrical conductors 11 (FIG. 2) which are aligned in a flat array and surrounded in an insulative casing 13 to form a flat cable 14. As illustrated herein, cable 14 is a 50-conductor cable, however, cables having other numbers of conductors may also be employed. An outer insulative jacket 16, typically formed of flexible vinyl or other suitable plastic material, surrounds flat cable 14. Positioned between jacket 16 and flat cable 14 on each side thereof is a metallic shield 18. Shield 18 is formed of a layer of thinly formed metal, such as aluminum, and extends on either side of flat cable 14 along the length of cable assembly 10. In FIG. 1 for illustrative purposes metallic shield 18 is shown peeled back from flat cable 14. In practice flat cable 14 is employed as a signal cable wherein selected ones of the 50 conductors are used to transmit signals between data terminals, data sources and the like. In order to efficiently transmit such signals, certain ones of the electrical conductors are placed at ground potential to provide a ground reference for the signal conductors. Placing certain ones of the cable conductors at ground potential provides for balanced impedience matching throughout the cable assembly and in conjunction with metal shell 28 may serve to tune the connector 20 to the impedence of the cable 10.

Figure 2:
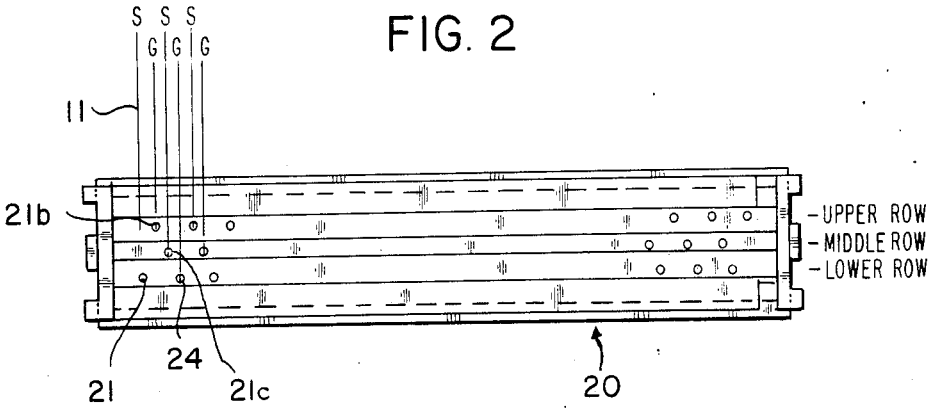
FIG. 2 shows in top plan view the electrical connector of FIG. 1.

In FIG. 1 cable assembly 10 is shown terminated in electrical connector 20. Referring additionally now to FIG. 2, electrical connector 20 is a conventional flat cable connector having an insulative housing 22 which supports therein a plurality of electrical contacts 24 (FIG. 6) for connection to the conductors of flat cable 14. Connector 20 may be of the type shown and described in U.S. Pat. No. 4,437,723, issued Mar. 20, 1984, and assigned to the assignee of the present invention. Connector 20, shown by way of preferred embodiment, is of the "D" connector variety having a front connection face 26 which surrounds extending portions 23 of contacts 24.

Figure 6:
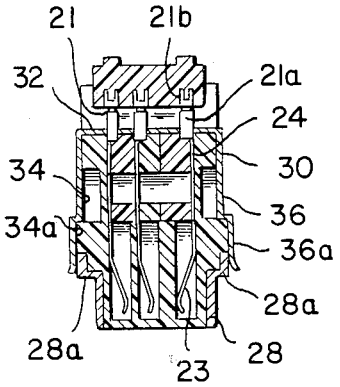
FIG. 6 is a vertical section of the connection assembly of FIG. 5 taken along the lines VI—VI.

As can be seen in FIGS. 1, 2 and 6 the contacts 24 are elongate and arranged in three successive rows of 17, 16 and 17 contacts each. Contact extending portions 23 are terminal elements of the pin or socket type for external interconnection. The pin type terminal is shown in FIG. 1, while the socket type terminal is shown in FIG. 6. Each of these terminal types are of conventional construction. Opposite extending terminal portions 23 contact 24 includes a cable connection end which generally may be referred to as an insulation displacing portion 21, which has a barrel portion **21*a* and a piercing portion 21*b* of conventional construction. Insulation displacing portions 21, of contacts 24, are arranged for mass termination with the conductors of cable 14**.

Surrounding the front face 26 of connector 20 is a metal connector shell 28 formed in a "D" configuration. Metal connector shell 28 facilitates interconnection of connector 20 and provides ground shielding and thus a ground reference to the connection assembly. Connector 20 further includes an insulative cover 25 (FIG. 5) which overlies the insulation displacing portions 21 and facilitates mass termination of flat cable 14 in a manner which is conventional is the art. A strain relief device 29 (FIG. 1), also known in the art, secures flat cable 14 to connector 20.

Figure 3:
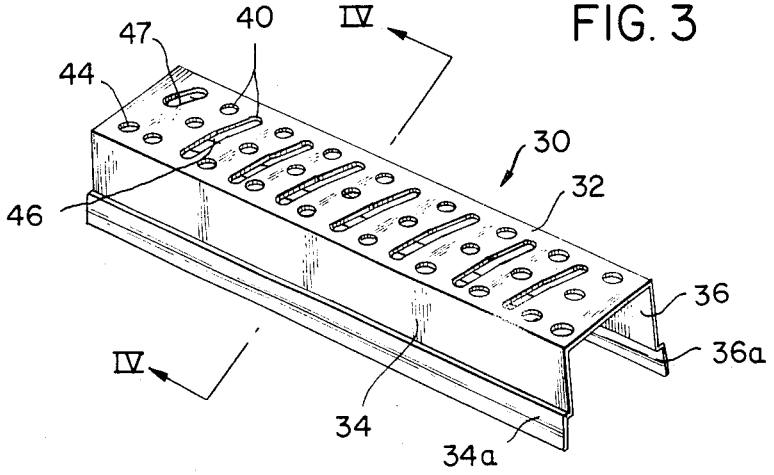
FIG. 3 shows in front prospective view the conductive grounding clip of the present invention.
Figure 4:
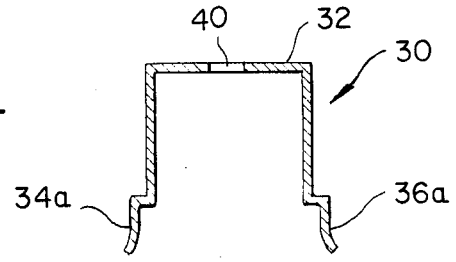
FIG. 4 is a vertical section of the clip of FIG. 3 taken along the lines IV—IV.

In typical signal transmission applications, as above noted, certain ones of 50 conductors of flat cable 14 are dedicated to ground to provide a ground reference for the remaining signal conductors. In most typical applications each signal conductor is surrounded on each side by a conductor dedicated to ground. Thus, the arrangement of conductor is G-S-G-S-G or S-G-S-G-S and so forth, where G represents a ground conductor and S represents a signal conductor. In order to make such connection to every other conductor of cable 14, the present invention provides a grounding clip, shown in FIGS. 3 and 4, which connects in unison every other contact of connector 20 (FIG. 2).

In mass terminating flat conductor cable 14 to connector 20 the insulation displacing portions 21, of contacts 24, are arranged at 0.050" spacings between the next longitudinally successive contact 24, which correspond to the spacings between the conductors of flat cable 14 which is an industry standard. Thus, each of the insulation displacing portions 21 will align with a unique conductor of flat cable 14. As shown in FIG. 2, insulation displacing portion 21, in the lower left hand corner, indicated as number **21*a*, will pick up the first outer most conductor of flat cable 14. The next adjacent conductor of flat cable 14 will be picked up by the left most contact 21*b* in the upper row, as seen in FIG. 2. The next inward conductor of cable 14 is picked up by the left most contact 21*c*, in the middle row. This pattern continues across the connecter whereupon each of the 50 conductors of cable 14 is picked up by a unique one of insulation displacing portions 21 of contacts 24**.

As noted above and as shown schematically in FIG. 2, every conductor across the array of cable 14 will be designated alternately as a signal or ground conductor. As shown by way of example in FIG. 2, the arrangement shown is S-G-S-G-S etc.

Returning now to FIGS. 3 and 4, the grounding clip 30 of the present invention is shown. Grounding clip 30 is an elongate conductive metallic U-shaped member having a planar first surface 32 and a pair of transversely spaced depending side walls 34 and 36. Flared leg portions **34*a* and 36*a* depend respectively from side walls 34 and 36 to provide for a resilient securement to connector 20** as will be described in greater detail hereinbelow.

Figure 8:
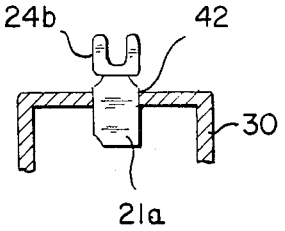
FIGS. 8 and 9 are schematic representations of the clip of FIG. 3 aligned with the contacts of the connector of FIG. 2.
Figure 9:
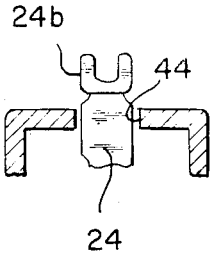

First surface 32 of clip 30, includes a patterned array of openings 40 therethrough. Openings 40 are arranged on first surface 32 to correspond to and align with the insulation displacing portions 21 of connector 20. Openings 40, on first surface 32, are in one of three different configurations. The first configuration, shown at 42, is an elongate opening having a narrow transverse dimension. The transverse dimension of opening 42 is selected to be somewhat less than the transverse diameter of the barrel portion **21*a* of contact 24. As shown in FIG. 8, when clip 30 is placed over contacts 24, of connector 20, the opening 42 will frictionally engage the side walls of the barrel portion 21*a* of contact 24. The walls defining opening 42 engage the contact 24 to thereby provide a gas-tight electrical engagement therebetween. This places contact 24 in electrical connection with grounding clip 30. As the walls of openings 42 engage the barrel portion 21*a* of contact 24 and not the piercing portion 21*b*, the insulation displacing connection of conductor 11 will not be hindered. A second type opening 44 is circular configuration having a diameter which is greater than the diameter of the barrel portion 21*b* of insulation displacing portion 21 of contact 24. The walls of opening 44 will pass freely over insulation displacing portion 21 and as is shown in FIG. 9 will not be in electrical contact therewith. A third shaped opening 46 is of similar type to opening 42 in that it is an elongate having a transverse extent which is less than the width of the barrel portion 21*a* so that frictional electrical engagement is made between the barrel position 21*a* of insulation displacing portion 21 and grounding clip 32 when the grounding clip is inserted over connector 20. However, opening 46 has a somewhat longer longitudinal extent than opening 42 to thereby pick up three adjacent insulation displacing portions 24b in unison. The 3 adjacent contacts 24, picked up by opening 46 span the 3 rows of connector 20**.

Figure 7:
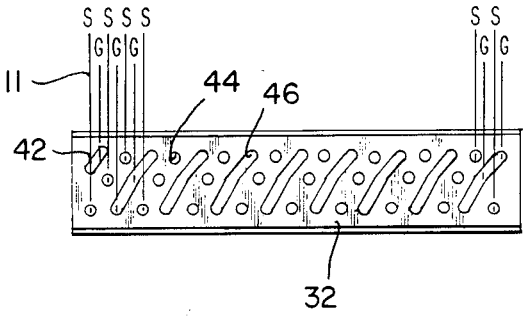
FIG. 7 is a schematic showings of the clip of FIG. 3 with the conductors of the cable shown thereover.

Referring now to FIG. 7, upper surface 32 of grounding clip 30 is shown schematically with the conductors of flat cable 14. As can be seen from the drawing every other conductor is picked up by an insulation displacing portion 21 (not shown) aligned with an opening 44 and thereby will not be in electrical engagement with grounding clip 32. The conductors aligned with the openings 44 are designated as the signal conductors. The other conductors will be picked up by insulation displacing portions 21 (not shown) aligned with either opening 42 or opening 46. Therefore, these conductors designated as ground conductors, will be in electrical engagement with grounding clip 30. It can be seen that each of the conductors designated as ground, will be in electrical connection with each other as they are in mutual electrical contact with first surface 32 of grounding clip 30. The conductors designated as signal conductors will not be in connection with grounding clip 32 or with each other due to the spacial isolation of the associated insulation displacing portion 21, as shown in FIG. 9.

Figure 5:
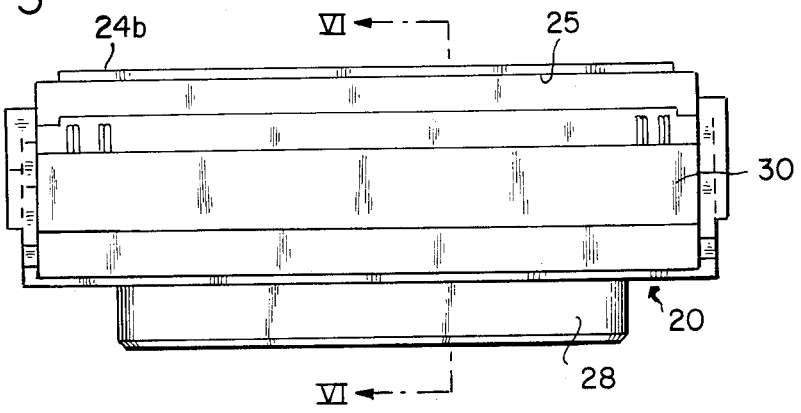
FIG. 5 shows in front plain view the electrical connector assembly of Fig 1, including the conductive clip of FIG. 3.

Turning now to FIGS. 5 and 6, the assembled connector 20 including grounding clip 30 is shown. Grounding clip 30 is placed over connector 20 with cover 25 removed such that depending side walls 34 and 36 straddle each longitudinal side of connector 20. The insulation displacing portions 21 of contacts 24 are accommodated in openings 40 (FIG. 3) of upper surface 32 of grounding clip 30 as previously described. The flaired leg portions 34a and 36a resiliently engage the distal extents 28a of metal shell 28 to thereby provide frictional electrical contact therebetween and place grounding clip 30 in electrical continuity with metal shell 28. In order to secure grounding clip 30, in mechanically and electrical contact with metal shell 28, detent means or similar devices can be employed. Cover 25 can then be inserted over connector 20 and can be used to mass terminate cable 14 (not shown) onto connector 20.

As mentioned hereinabove conductive shell 28, of connector 20, is placed in electrical continuity with the shield 18 (FIG. 1) of cable assembly 10 in a manner conventionally known in the art. Since the ground conductors of cable 14 are terminated by contacts 24 which are in electrical engagement with grounding clip 32, the ground conductors of cable 14, the metal shell 28 and the cable shield 18 will all be at similar ground potential. While ground continuity between the ground conductors of cable 14 and the ground shield 18 of cable assembly 10 is achieved through the grounding clip 32 and the metal shell 28, it is contemplated that the grounding clip 30 can be coupled directly to the shield 18 of cable assembly 10 to provide direct ground continuity.

Various other modification to the foregoing disclosed embodiment will be evident to those skilled in the art. Thus, the particuarly described preferred embodiment is intended to be illustrative and not limiting. The true scope of the invention is set forth in the following claims.

We claim:

1. An electrical connector assembly for terminating electrical cable having a plurality of conductors and an outer insulative jacket, said assembly comprising:

an insulative housing for supporting said cable;

a plurality of electrical contacts supported in said housing for electrical engagement with said conductors of said cable;

a conductive shell supporting said housing; and a conductive element having a first portion supported on said housing in alignment with said electrical contacts, said first portion having first openings dimensioned for accommodating therethrough selected ones of said contacts by friction fit such that said selected contacts electrically engage said first portion and second openings dimensioned for accommodating contacts other than said selected contacts such that said other contacts are electrically isolated from said first portion and a second portion electrically connected to said conductive shell providing electrical continuity between said selected contacts and said conductive shell.

2. An electrical connector assembly of claim 1 wherein said electrical contacts are elongate having at one end thereof a cable connection portion including an insulation displacing element for insulation displacing connection with said conductors of said cable, each of said cable connection portions having a given transverse dimension.

3. A termination assembly for terminating shielded flat multiconductor cable having a plurality of insulated conductors, a metallic shield overlying said conductors and an outer insulative jacket, said assembly comprising a connector housing for accommodating said cable;

plural electrical contacts supported in said housing for electrical engagement with said conductors of said cable;

an outer conductive shell supporting said connector housing; and a conductive clip supported on said connector housing including a first surface having plural openings therethrough, said plural openings being of a first and second type, said first type plural openings being positioned in alignment with plural selected contacts and said second type plural openings being positioned in alignment with contacts other than said selected contacts, said first surface electromechanically engaging said selected contacts about said openings of said first type and said first surface being in non-engaging relation with said other contacts, said conductive clip having means for engagement with said outer conductive shell.

4. A termination assembly of claim 3 wherein said plural electrical contacts are elongate members having a first insulation displacing end portion for electrical engagement with said conductors and a second terminal end portion.

5. A termination assembly of claim 4 wherein said contact first end portions have a given transverse extent.

6. A termination assembly of claim 3 wherein each of said first type plural openings has an opening extent which is less than said given extent and wherein said contact connection means includes said first type openings.

7. A termination assembly of claim 6 where said conductive clip includes a second surface depending from first said surface in electrical engagement with said outer conductive shell and wherein said engagement means includes said second surface.

8. An electrical connector assembly for terminating electrical cable having a plurality of conductors and an outer insulated jacket, said assembly comprising:

an insulative body;

a cover supported over said body for accommodating a portion of said cable thereinbetween;

plural elongage electrical contacts supported in said body, each contact having a terminal end portion extending from said body and a cable connection portion adjacent said cover;

a conductive shell partially enclosing said body;

a conductive clip in electrical engagement with said conductive shell, said conductive clip having a first planar surface including plural openings thorugh which said cable connection portions of said contacts extend, selected openings of said planar surface being dimensioned such that said planar surface bounding said selected openings frictionally engage said cable connecting portion of selected contacts and other openings of said planar surface being dimensioned such that said planar surface bounding said other openings is in non-engagement with said cable connection portion of said other contacts.

9. An electrical connection assembly of claim 8 wherein said each of said selected openings bounds plural cable connection portions of selected contacts.

* * * * *